US009147360B2

(12) United States Patent
Oh et al.

(10) Patent No.: US 9,147,360 B2
(45) Date of Patent: Sep. 29, 2015

(54) APPARATUS AND METHOD FOR DRIVING OF ORGANIC LIGHT EMITTING DISPLAY DEVICE

(71) Applicant: LG DISPLAY CO., LTD., Seoul (KR)

(72) Inventors: Jinyoung Oh, Paju-si (KR); JaeHyeong Jeong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 209 days.

(21) Appl. No.: 13/712,279

(22) Filed: Dec. 12, 2012

(65) Prior Publication Data

US 2014/0104258 A1 Apr. 17, 2014

(30) Foreign Application Priority Data

Oct. 15, 2012 (KR) ..... 10-2012-0114037

(51) Int. Cl.
*G09G 5/00* (2006.01)
*G09G 3/32* (2006.01)

(52) U.S. Cl.
CPC ..... *G09G 3/3291* (2013.01); *G09G 3/3233* (2013.01); *G09G 2330/025* (2013.01); *G09G 2340/16* (2013.01); *G09G 2360/16* (2013.01)

(58) Field of Classification Search
CPC ..... G09G 2340/16; G09G 2330/021; G09G 3/3208; G09G 3/3233
See application file for complete search history.

(56) References Cited

U.S. PATENT DOCUMENTS

| | | | | |
|---|---|---|---|---|
| 2007/0126672 | A1 | 6/2007 | Tada et al. | |
| 2008/0180367 | A1* | 7/2008 | Lee | 345/80 |
| 2009/0167790 | A1* | 7/2009 | Lin et al. | 345/690 |
| 2009/0195484 | A1* | 8/2009 | Lee et al. | 345/76 |
| 2011/0050754 | A1 | 3/2011 | Hyun | |
| 2012/0044270 | A1* | 2/2012 | Arkhipov et al. | 345/690 |
| 2013/0169695 | A1* | 7/2013 | Hyeon et al. | 345/690 |
| 2014/0132590 | A1 | 5/2014 | Inoue et al. | |

FOREIGN PATENT DOCUMENTS

| | | | |
|---|---|---|---|
| CN | 101030346 | A | 9/2007 |
| CN | 101681590 | A | 3/2010 |
| CN | 102376253 | A | 3/2012 |

OTHER PUBLICATIONS

Office Action dated May 26, 2015 for corresponding Chinese Application No. 201210566952.0, 12 pages.

* cited by examiner

*Primary Examiner* — Lixi C Simpson
(74) *Attorney, Agent, or Firm* — Brinks Gilson & Lione

(57) ABSTRACT

Disclosed is an apparatus and method for driving an organic light emitting display device which controls a current flowing in a display panel to be lower than a current limit value, the apparatus comprising a display panel including a plurality of pixels, wherein each pixel is provided with a light emitting device which emits light according to a current corresponding to a data voltage; and a panel driver that predicts a panel current value flowing in the display panel on the basis of data of a preceding frame and data of a current frame simultaneously displayed on the display panel, and controls the data voltage to be displayed on the display panel so as to make the panel current value be lower than a preset current limit value.

23 Claims, 7 Drawing Sheets

APPARATUS AND METHOD FOR DRIVING OF ORGANIC LIGHT EMITTING DISPLAY DEVICE

CROSS REFERENCE TO RELATED APPLICATIONS

This application claims the benefit of the Korean Patent Application No. 10-2012-0114037 filed on Oct. 15, 2012, which is hereby incorporated by reference as if fully set forth herein.

BACKGROUND

1. Field of the Disclosure

The present disclosure relates to an organic light emitting display device, and more particularly, to an apparatus and method for driving an organic light emitting display device which facilitates to control a current flowing in a display panel to be lower than a current limit value.

2. Discussion of the Related Art

Due to recent multimedia developments, there is an increasing demand for a flat panel display. In order to satisfy this increasing demand, various flat panel displays such as liquid crystal display, plasma display panel, field emission display and organic light emitting display are practically used. Among the various flat panel displays, the organic light emitting display device has been attracted as a next-generation flat panel display owing to advantages of rapid response speed and low power consumption. In addition, the organic light emitting display device can emit light in itself, whereby the organic light emitting display device does not cause a problem related with a narrow viewing angle.

Generally, the organic light emitting display device displays an image by applying a data voltage to each pixel, and controlling a current flowing in an organic light emitting device according to a data current corresponding to the data voltage. For this, each pixel includes the organic light emitting device, a switching transistor, a driving transistor, and at least one capacitor.

An amount of light emitted from the organic light emitting device is proportional to a current amount supplied from the driving transistor. The switching transistor is switched according to a scanning signal, whereby the switching transistor supplies the data voltage supplied from a data line to the driving transistor. The driving transistor is switched according to the data voltage supplied from the switching transistor, whereby the driving transistor generates the data current based on the data voltage, and supplies the generated data current to the organic light emitting device. The capacitor maintains the data voltage supplied to the driving transistor for 1 frame period.

Generally, the organic light emitting display device according to the related art displays the image on a display panel by a data addressing method, wherein the data addressing method updates data of a current frame in data of a preceding frame displayed on the display panel. Accordingly, the organic light emitting display device according to the related art is disadvantageous in that an overcurrent momentarily flows in the display panel according to the image of preceding and current frames, as shown in FIG. 1.

In more detail, as shown in FIG. 1, the preceding frame has black data to be displayed on an upper region of the display panel, and white data to be displayed on a lower region of the display panel. The current frame has white data to be displayed on the upper region of the display panel, and black data to be displayed on the lower region of the display panel. If displaying the data of the preceding frame and the data of the current frame according to a vertical synchronous signal on the display panel by the data addressing method, the white data of the preceding frame and the white data of the current frame may be simultaneously displayed on the display panel during a partial addressing period of the current frame, whereby the overcurrent, which is higher than a current corresponding to the data for each frame, flows in the display panel.

Meanwhile, the organic light emitting display device according to the related art has a maximum allowable current value capable of flowing in the display panel so as to ensure reliability of device (or product) and safety from the overcurrent. For example, on assumption that the maximum allowable current value of the organic light emitting display device according to the related art is 10 A, if the current value flowing in the display panel according to the white data in each of the preceding and current frames shown in FIG. 1 is 10 A, the current value flowing in the display panel for almost all sections of the current frame is higher than the maximum allowable current value, 10 A.

In the organic light emitting display device according to the related art, a power supplier may be shut-down due to the overcurrent momentarily flowing in the display panel according to the image of preceding and current frames, whereby the image is not displayed on the display panel, thereby deteriorating the reliability of device (or product).

SUMMARY

An apparatus for driving an organic light emitting display device comprising: a display panel including a plurality of pixels, wherein each pixel is provided with a light emitting device which emits light according to a current corresponding to a data voltage; and a panel driver that predicts a panel current value flowing in the display panel on the basis of data of a preceding frame and data of a current frame simultaneously displayed on the display panel, and controls the data voltage to be displayed on the display panel so as to make the panel current value be lower than a preset current limit value.

In another aspect of the present invention, there is provided a method for driving an organic light emitting display device including a display panel for displaying an image by making a light emitting device in each of plural pixels emit light by the use of current corresponding to a data voltage, comprising: predicting a panel current value flowing in the display panel on the basis of data of a preceding frame and data of a current frame simultaneously displayed on the display panel; and controlling the data voltage to be displayed on the display panel so as to make the predicted panel current value be lower than a preset current limit value.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, an apparatus and method for driving an organic light emitting display device according to the present invention will be described with reference to the accompanying drawings.

Figure 1:
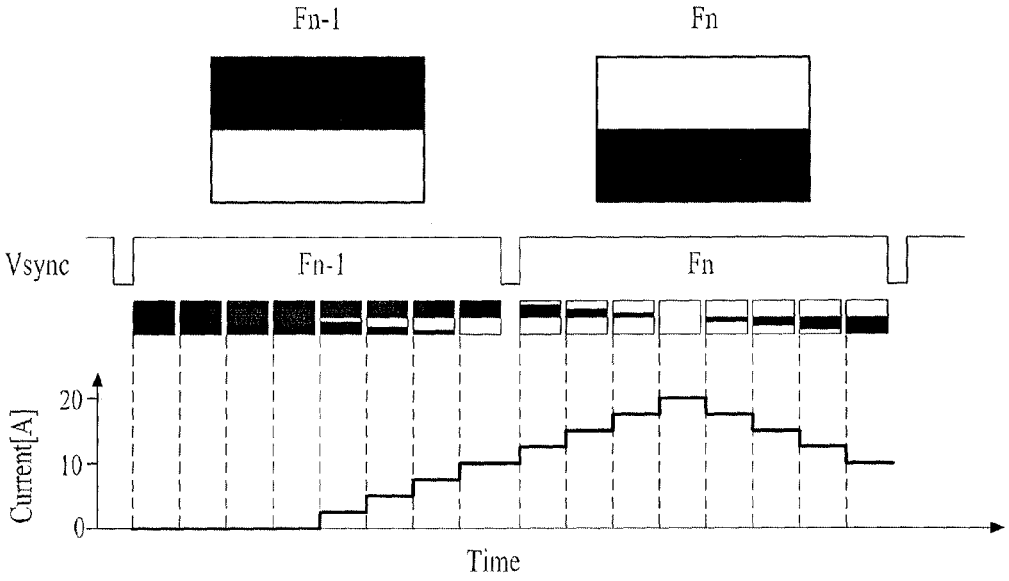
FIG. 1 Related Art
FIG. 1 illustrates that an overcurrent flows in a display panel of a related art organic light emitting display device according to images of preceding and current frames.
Figure 2:
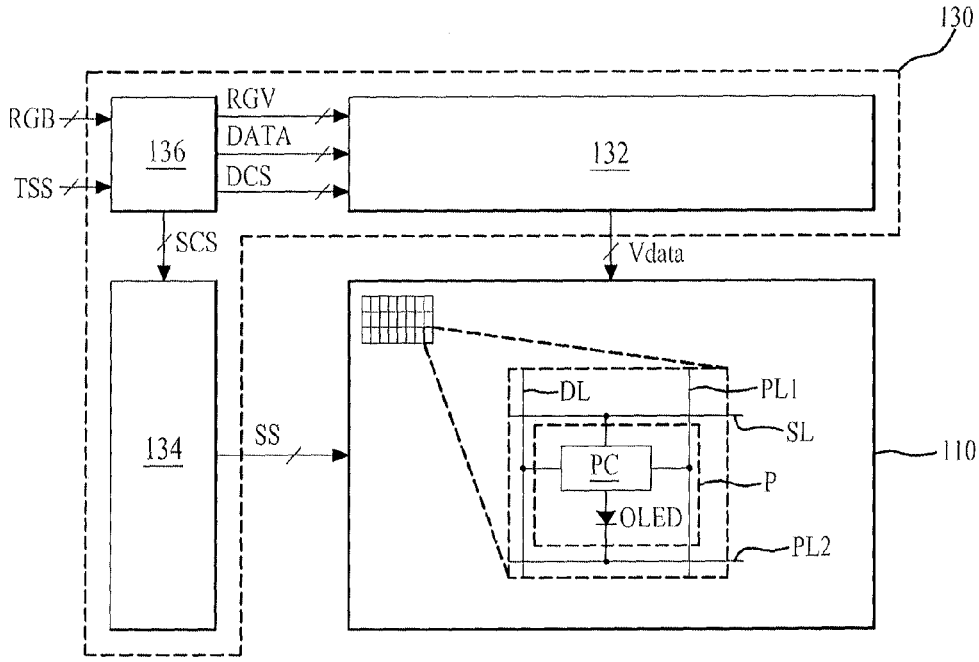
FIG. 2 illustrates an apparatus for driving an organic light emitting display device according to the embodiment of the present invention.

FIG. 2 illustrates an apparatus for driving an organic light emitting display device according to the embodiment of the present invention.

Referring to FIG. 2, an apparatus for driving an organic light emitting display device according to the embodiment of the present invention includes a display panel 110 and a panel driver 130. The display panel 110 comprises a plurality of pixels (P) including a plurality of organic light emitting devices (OLED), which emit light by a current corresponding to a data voltage (Vdata). The panel driver 130 predicts a panel current value flowing in the display panel 110 on the basis of data of preceding and current frames to be simultaneously displayed on the display panel 110, and controls the data voltage (Vdata) to be displayed on the display panel 110 so as to make the panel current value be lower than a preset current limit value.

In the display panel 110, the organic light emitting device (OLED) for each pixel (P) emits light according to the data voltage supplied from the panel driver 130, whereby a predetermined color image is displayed through the use of light emitted from each pixel (P). For this, the display panel 110 includes a plurality of data lines (DL) and scanning lines (SL) crossing each other to define respective pixel regions; a plurality of first driving power source lines (PL1) provided in parallel to the plurality of data lines (DL); and a plurality of second driving power source lines (PL2) provided in perpendicular to the plurality of first driving power source lines (PL1).

The plurality of data lines (DL) are formed at fixed intervals in a first direction, and the plurality of scanning lines (SL) are formed at fixed intervals in a second direction being in perpendicular to the first direction. The first driving power source line (PL1) is formed in parallel to each of the data lines (DL) while being adjacent to each of the data lines (DL), whereby an externally-provided first driving power is supplied to the first driving power source line (PL1).

Each of the second driving power source lines (PL2) is formed in perpendicular to each of the first driving power source lines (PL1), whereby an externally-provided second driving power is supplied to the second driving power source line (PL2). In this case, a voltage level of the second driving power may be lower than that of the first driving power, or the second driving power may have a ground voltage level.

Meanwhile, the display panel 110 may include a common electrode instead of the plurality of second driving power source lines (PL2). In this case, the common electrode is formed on an entire display area of the display panel 110, whereby the externally-provided second driving power may be supplied to the common electrode.

Each of the pixels (P) may be formed of any one color among red, green, blue and white colors. Accordingly, a unit pixel for displaying a color image by the plurality of pixels (P) may comprise the neighboring red pixel, green pixel and blue pixel, or may comprise the neighboring red pixel, green pixel, blue pixel and white pixel. Meanwhile, the unit pixel may comprise red, green, sky blue and deep blue colors. Eventually, the plurality of pixels (P) may comprise various colors of red, green, white, sky blue, deep blue, yellow and bluish green colors, and the unit pixel may comprise at least three pixels of different colors.

Each of the pixels (P) may include the organic light emitting device (OLED) and a pixel circuit (PC).

The organic light emitting device (OLED) is connected between the pixel circuit (PC) and the second driving power source line (PL2), wherein the organic light emitting device (OLED) emits light in proportion to an amount of data current supplied from the pixel circuit (PC), to thereby emit a predetermined color light. For this, the organic light emitting device (OLED) includes an anode electrode (or pixel electrode) connected with the pixel circuit (PC); a cathode electrode (or reflective electrode) connected with the second driving power source line (PL2); and an organic light emitting cell for emitting any one color among red, green, blue and white colors, wherein the organic light emitting cell is formed between the anode electrode and the cathode electrode. In this case, the organic light emitting cell may be formed in a deposition structure of hole transport layer/organic light emitting layer/electron transport layer, or a deposition structure of hole injection layer/hole transport layer/organic light emitting layer/electron transport layer/electron injection layer. Further, the organic light emitting cell may be additionally provided with a functional layer for improving light-emitting efficiency and/or lifespan of the organic light emitting device (OLED).

In response to a scanning signal (SS) supplied from the panel driver 130 to the scanning line (SL), the pixel circuit (PC) makes the data current flow in the organic light emitting device (OLED), wherein the data current corresponds to the data voltage (Vdata) supplied from the panel driver 130 to the data line (DL). For this, the pixel circuit (PC) includes at least one capacitor, a driving transistor, and a switching transistor formed on a substrate during a process for forming a thin film transistor.

The switching transistor is switched according to the scanning signal (SS) supplied to the scanning line (SL), whereby the data voltage (Vdata) supplied from the data line (DL) is supplied to the driving transistor. The driving transistor is switched according to the data voltage (Vdata) supplied from the switching transistor, whereby the switched driving transistor generates the data current based on the data voltage (Vdata), and supplies the generated data current to the organic light emitting device (OLED), to thereby make the organic light emitting device (OLED) emit light in proportion to the amount of data current. Also, at least one capacitor maintains the data voltage (Vdata) supplied to the driving transistor for 1 frame period.

In the pixel circuit (PC) for each pixel (P), there is a deviation of a threshold voltage of the driving transistor according to driving time of the driving transistor, whereby picture quality might be deteriorated. Accordingly, the organic light emitting display device according to the present invention may further include a compensation circuit for compensating the threshold voltage of the driving transistor.

The compensation circuit may be formed by an internal compensation method for compensating the threshold voltage of the driving transistor inside the pixel circuit (PC), or an external compensation method for compensating the threshold voltage of the driving transistor in the panel driver 130.

The compensation circuit of the internal compensation method is provided with at least one compensation transistor and at least one compensation capacitor inside the pixel circuit (PC). The compensation circuit of the internal compensation method compensates the threshold voltage of each driving transistor by storing the threshold voltage of the driving transistor and the data voltage in the capacitor during a period for detecting the threshold voltage of each driving transistor.

The compensation circuit of the external compensation method includes a sensing transistor connected with the driving transistor of the pixel circuit (PC); a sensing line connected with the sensing transistor and formed in the display panel 110; and a threshold voltage sensing circuit connected with the sensing line and formed in the panel driver 130. The compensation circuit of the external compensation method senses the threshold voltage of the driving transistor through the sensing line when the sensing transistor is driven by the use of threshold voltage sensing circuit, and compensates input data (RGB) on the basis of the sensed threshold voltage of the driving transistor, to thereby compensate the threshold voltage of each driving transistor.

The panel driver 130 controls the data voltage (Vdata) of the current frame so as to make the predicted panel current value be lower than the preset current limit value through a data analysis based on the data of the preceding and current frames to be simultaneously displayed on the display panel 110; and emits the organic light emitting device (PLED) of each pixel (P) emit light by supplying the controlled data voltage (Vdata) of the current frame to the display panel 110 displayed with the data of the preceding frame, whereby the panel current value flowing in the display panel 110 is controlled to be lower than the preset current limit value.

In more detail, the panel driver 130 according to one embodiment of the present invention divides one frame into a plurality of sub-frames simultaneously displayed with the data of the preceding and current frames; predicts the panel current value for each sub-frame from the data of the preceding and current frames of each sub-frame; and controls the data voltage (Vdata) of the current frame every each sub-frame so as to make the panel current value of each sub-frame be lower than the preset current limit value. In this case, the image of one frame is displayed by sequentially updating the data of the current frame in the data of the preceding frame displayed on the display panel 110 according to a data addressing order (or image displaying order) for supplying the scanning signal (SS) to the scanning line (SL). Accordingly, one frame may be divided into the plurality of sub-frames according to the data addressing order; some of the sub-frames may be provided with the input data of the preceding and current frames simultaneously displayed on the display panel 110; and the last sub-frame among the plurality of sub-frames may be provided with only the input data of the current frame.

Accordingly, the panel driver 130 according to one embodiment of the present invention predicts a sub-frame current prediction value flowing in the display panel 110 by analyzing the input data (RGB) for each sub-frame; and controls the data voltage (Vdata) of the current frame included in each sub-frame so as to make the predicted sub-frame current prediction value be lower than the preset current limit value. For example, if the sub-frame current prediction value, which is predicted based on the input data (RGB) for each sub-frame, is the same as or higher than the preset current limit value, the panel driver 130 controls the data voltage (Vdata) of the current frame included in the sub-frame to be a black voltage, whereby the current value flowing in the display panel 110 becomes 0 (zero) by the input data of the current frame included in the sub-frame. Meanwhile, if the sub-frame current prediction value, which is predicted based on the input data (RGB) for each sub-frame, is lower than the preset current limit value, the panel driver 130 controls the data voltage (Vdata) of the current frame included in the sub-frame so that the current value flowing in the display panel 110 becomes a differential current value between the current limit value and the current value flowing in the display panel 110 according to the input data of the preceding frame included in the sub-frame by the input data of the current frame included in the sub-frame.

The panel driver 130 according to another embodiment of the present invention divides the display area of the display panel 110 into a plurality of division regions; predicts the panel current value by analyzing the input data (RGB) of the preceding frame displayed in some of the division regions according to the data addressing, and the input data (RGB) of the current frame to be displayed in the remaining division regions according to the data addressing; and controls the data voltage (Vdata) of the current frame to be displayed in the remaining division regions so as to make the panel current value be lower than the current limit value. For example, if the panel current value of the preceding frame predicted from the input data of the preceding frame displayed in some of the division regions is the same as or higher than the current limit value, the panel driver 130 controls the data voltage (Vdata) of the current frame to be supplied to each pixel (P) of the remaining division regions to be the black voltage, whereby the panel current value flowing in the remaining division regions becomes 0 (zero). Meanwhile, if the panel current value of the preceding frame predicted from the input data of the preceding frame displayed in some of the division regions is the lower than the current limit value, the panel driver 130 controls the data voltage (Vdata) of the current frame to be supplied to each pixel (P) of the remaining division regions, whereby the panel current value flowing in the remaining division regions becomes the differential current voltage between the current limit value and the panel current value of the preceding frame.

The panel driver 130 controls the data voltage (Vdata) to be supplied to each pixel (P) by controlling at least one of the input data (RGB) and a plurality of reference gamma voltages (RGV) used for generating the data voltage (Vdata) so that the current value flowing in the display panel 110 is lower than the preset current limit value.

The panel driver 130 controls the data voltage (Vdata) according to the input data (RGB) of the current frame so as to make the current value flowing in the display panel 110 be lower than the preset current limit value, whereby the organic light emitting device (OLED) for each pixel (P) emits light.

As mentioned above, the panel driver 130, which controls the current value flowing in the display panel 110 to be lower than the preset current limit value, includes a data driver 132, a scanning driver 134, and a controller 136.

The data driver 132 is supplied with the plurality of reference gamma voltage (RGV), a data control signal (DCS) and conversion data (DATA) from the controller 136. Accordingly, the data driver 132 converts the conversion data (DATA) of digital type into the data voltage (Vdata) of analog type by the use of reference gamma voltages (RGV) according to the data control signal (DCS); and then supplies the data voltage (Vdata) of analog type to the data line (DL) by each unit of horizontal period of the display panel 110.

The scanning driver 134 is supplied with a scanning control signal (SCS) from the controller 136. The scanning driver 134 generates a scanning signal (SS) according to the scanning control signal (SCS), and then sequentially supplies the generated scanning signal (SS) to the plurality of scanning lines (SL). Accordingly, the switching transistor of each pixel circuit (PC) is turned-on by the scanning signal (SS) supplied to the scanning line (SL), whereby the data voltage (Vdata) supplied to the data line (DL) is supplied to a gate electrode of the driving transistor, and the driving transistor supplies the data current corresponding to the data voltage (Vdata) to the organic light emitting device (OLED), to thereby make the organic light emitting device (OLED) emit light. The scanning driver 134 may be formed in a non-display area at one side and/or the other side of the display panel 110 by Gate-In-Panel (GIP) method during a thin film transistor process of the aforementioned display panel 110; or the scanning driver 134 of a chip type may be mounted on the non-display area by Chip-On-Glass (COG) method.

The controller 136 controls a driving timing for each of the data driver 132 and the scanning driver 134 according to a timing synchronous signal (TSS) input from the external system body or graphic card. That is, the controller 136 generates a data control signal (DCS) on the basis of timing synchronous signal (TSS) such as vertical synchronous signal (Vsync), horizontal synchronous signal (Hsync), data enable (DE) and clock (DCLK), and controls the driving timing for the data driver 132 according to the data control signal (DCS). Also, the controller 136 controls the driving timing for the scanning driver 134 by generating the scanning control signal (SCS).

Also, the controller 136 generates the conversion data (DATA) by aligning the input data (RGB), input from the external system body (not shown) or graphic card (not shown), to be appropriate for the driving of the display panel 110; and then supplies the generated conversion data (DATA) to the data driver 132, or supplies the corrected conversion data (DATA) to the data driver 132.

The controller 136 predicts the current value flowing in the display panel 110 by analyzing the input data (RGB) of the current frame, generates the plurality of reference gamma voltages (RGV) for controlling the data voltage (Vdata) to be supplied to each pixel (P) so as to make the predicted current value be lower than the preset current limit value, and supplies the plurality of reference gamma voltages (RGV) to the data driver 132; or corrects the input data (RGB) of the current frame and supplies the corrected input data to the data driver 132. The controller 136 generates the plurality of reference gamma voltages (RGV) for controlling the data voltage (Vdata) to be supplied to each pixel (P) so as to make the current value flowing in the display panel 110 simultaneously displayed with the input data (RGB) of the preceding frame and the input data (RGB) of the current frame be lower than the preset current limit value by analyzing the input data (RGB) of the preceding and current frames and the conversion data (DATA) of the preceding and current frames, and supplies the plurality of reference gamma voltages (RGV) to the data driver 132; or corrects the input data (RGB) of the current frame, and supplies the corrected input data (RGB) to the data driver 132.

Figure 3:
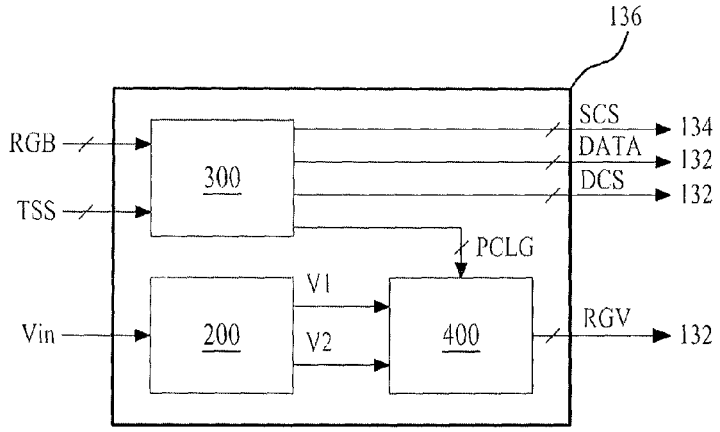
FIG. 3 is a block diagram illustrating a controller, shown in FIG. 2, according to the first embodiment of the present invention.

FIG. 3 is a block diagram illustrating the controller, shown in FIG. 2, according to the first embodiment of the present invention.

Referring to FIG. 3, the controller 136 according to the first embodiment of the present invention generates a panel current limit gain value (PCLG) for controlling the current value flowing in the display panel 110 to be lower than the preset current limit value on the basis of the input data (RGB) of the preceding and current frames and the conversion data (DATA) of the preceding and current frames; and generates the plurality of reference gamma voltage (RGV) by the generated panel current limit gain value (PCLG). Also, the controller 136 according to the first embodiment of the present invention generates the data control signal (DCS) and the scanning control signal (SCS) on the basis of the input timing synchronous signal (TSS); and supplies the data control signal (DCS) to the data driver 132, and supplies the scanning control signal (SCS) to the scanning driver 134. For this, the controller 136 according to the first embodiment of the present invention includes a power supplier 200, a timing controller 300, and a reference gamma voltage generator 400. The controller 136 may be a control board or control printed circuit board (control PCB) connected with the display panel 110, wherein the control board or control PCB may be with the power supplier 200, the timing controller 300, and the reference gamma voltage generator 400 mounted thereon.

The power supplier 200 generates and outputs various driving voltages for displaying the image on the display panel 110 by the use of input power (Vin) supplied from the external.

The timing controller 300 according to the first embodiment of the present invention generates the aforementioned data control signal (DCS) and the scanning control signal (SCS) on the basis of the timing synchronous signal (TSS); and controls the driving for each of the data driver 132 and the scanning driver 134.

Also, the timing controller 300 generates the conversion data (DATA) by converting the input data (RGB) of the frame unit into the data appropriate for the driving of the display panel 110. The timing controller 300 generates the panel current limit gain value (PCLG) for controlling the current value flowing in the display panel 110 to be lower than the present current limit value on the basis of the input data (RGB) of the preceding and current frames and the conversion data (DATA) of the preceding and current frames; and supplies the generated panel current limit gain value (PCLG) to the reference gamma voltage generator 400. In this case, the current limit value is preset based on the allowable current value for preventing shut-down of the power supplier 200 due to the overcurrent, the size of the display panel 110, the decrease in lifespan due to the light-emitting operation of the organic light emitting device, power consumption, and the cost of power supplier 200. The timing controller 300 according to the first embodiment of the present invention will be described in detail with reference to FIGS. 4 and 5.

The reference gamma voltage generator 400 determines voltage levels of the first and second driving voltages (V1, V2) for generating the gamma voltage from the power supplier 200 according to the panel current limit gain value (PCLG) supplied from the timing controller 300; divides the first and second driving voltages (V1, V2) into the determined voltage levels; and supplies the plurality of reference gamma voltages (RGV) generated differently from one another to the data driver 132.

The reference gamma voltage generator 400 according to one embodiment of the present invention generates a plurality of common reference gamma voltages (RGV) which are applied in common to convert the input data (RGB) of red, green and blue colors into the data voltage (Vdata) according to the panel current limit gain value (PCLG).

The reference gamma voltage generator 400 according to another embodiment of the present invention may generate a plurality of red reference gamma voltages, a plurality of green reference gamma voltages, and a plurality of blue reference gamma voltages which are separately (or individually) applied to convert the input data (RGB) of red, green and blue colors into the separate (or individual) data voltage (Vdata) according to the panel current limit gain value (PCLG).

Further, if the unit pixel of the display panel 100 comprise the red pixel, green pixel, blue pixel and white pixel, the reference gamma voltage generator 400 according to another embodiment of the present invention may generate the plurality of red, green, blue and white reference gamma voltages, which are different from one another, according to the panel current limit gain value (PCLG).

The aforementioned reference gamma voltage generator 400 may be realized in a programmable gamma integrated circuit (programmable gamma IC) for generating the plurality of reference gamma voltages (RGV) according to the panel current limit gain value (PCLG).

The controller 136 according to the first embodiment of the present invention calculates the panel current limit gain value (PCLG) on the basis of the input data (RGB) of the preceding and current frames; generates the plurality of reference gamma voltage (RGV) according to the calculated panel current limit gain value (PCLG); and controls the panel current value flowing in the display panel 110 to be lower than the preset current limit value.

Figure 4:
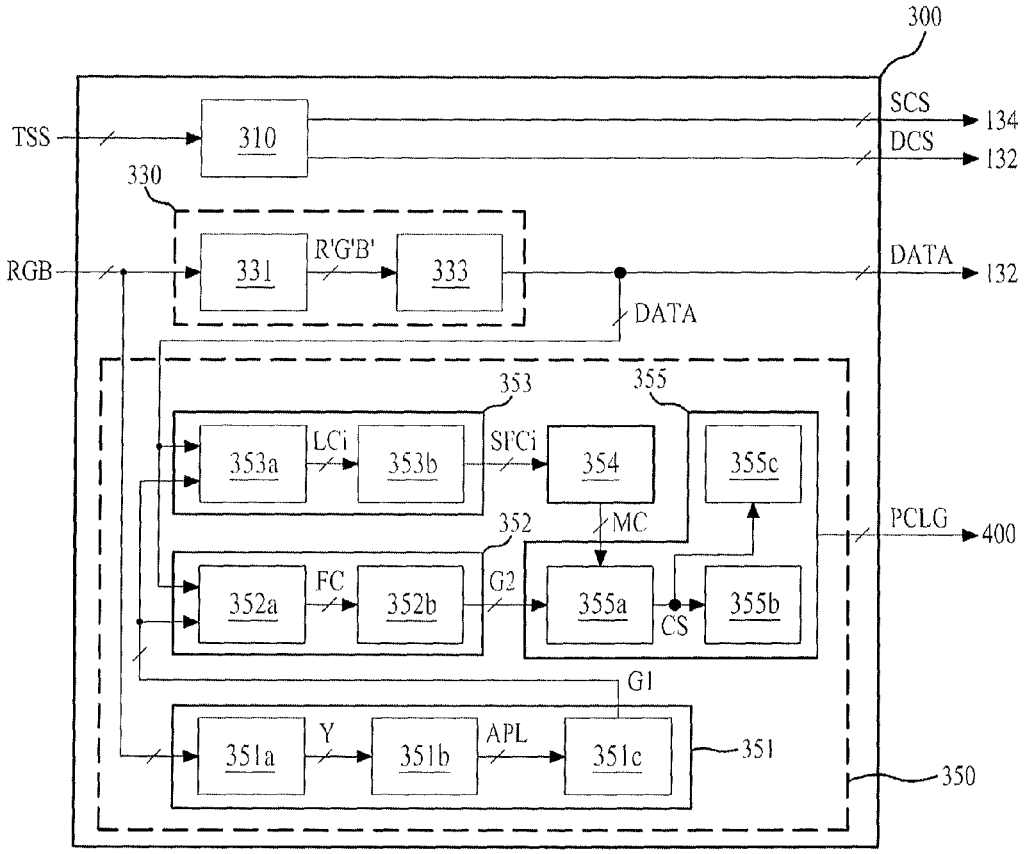
FIG. 4 is a block diagram illustrating a timing controller, shown in FIG. 3, according to the first embodiment of the present invention.

FIG. 4 is a block diagram illustrating the timing controller, shown in FIG. 3, according to the first embodiment of the present invention.

Referring to FIGS. 3 and 4, the timing controller 300 according to the first embodiment of the present invention includes a control signal generator 310, a data processor 330, and a panel current limiter 350.

As mentioned above, the control signal generator 310 generates the aforementioned data control signal (DCS) and the scanning control signal (SCS) on the basis of the timing synchronous signal (TSS); and supplies the generated data control signal (DCS) to the data driver 132, and supplies the generated scanning control signal (SCS) to the scanning driver 134.

The data processor 330 according to one embodiment of the present invention generates the conversion data (DATA) by aligning the input data (RGB) of red, green and blue colors, stored in a memory device, so as to be appropriate for the driving of the display panel 110; and supplies the generated conversion data (DATA) to the data driver 132 and the panel current limiter 350. The data processor 330 according to one embodiment of the present invention may generate the conversion data (DATA) by the gamma correction of the aligned input data of the red, green and blue colors. In the organic light emitting display device including the timing controller 300 with the data processor 330 according to one embodiment of the present invention, the unit pixel of the aforementioned display panel 110 comprises the red pixel, the green pixel and the blue pixel.

The data processor 330 according to another embodiment of the present invention) aligns the input data (RGB) of red, green and blue colors, stored in the memory device, so as to be appropriate for the driving of the display panel 110; extracts white data from the aligned input data (R'G'B') of the red, green and blue colors; generates the conversion data (DATA) comprising the extracted red, green, blue and white data; and then supplies the generated conversion data (DATA) to the data driver 132 and the panel current limiter 350. The data processor 330 according to another embodiment of the present invention may provide a gamma-correct for the aligned input data (R'G'B') of the red, green and blue colors; and extract the white data from the gamma-corrected input data (R'G'B') of the red, green and blue colors. In the organic light emitting display device including the timing controller 300 with the data processor 330 according to another embodiment of the present invention, the unit pixel of the aforementioned display panel 110 comprises the red pixel, the green pixel, the blue pixel and the white pixel. For this, the data processor 330 according to another embodiment of the present invention includes a data aligner 331 and a data converter 333.

The data aligner 331 generates the aligned data (R'G'B') by aligning the input data (RGB) of red, green and blue colors, stored in the memory device, so as to be appropriate for the driving of the display panel 110; and supplies the aligned data (R'G'B') to the data converter 333.

The data converter 333 extracts the white data on the basis of the input data (RGB) of red, green and blue colors stored in the memory device; and generates the conversion data (DATA) comprising the red, green, blue and white data. In this case, the white data may be generated by the input data with the lowest value among the input data (RGB) of red, green and blue colors for each unit pixel, but not necessarily. The white data may be generated in various methods for converting 3-color data (RGB) into 4-color data (RGBW).

The panel current limiter 350 generates the panel current limit gain value (PCLG), which controls the panel current value flowing in the display panel 110 to be lower than the preset current limit value, by analyzing the input data (RGB) of the frame unit and the conversion data (DATA); and supplies the generated panel current limit gain value (PCLG) to the reference gamma voltage generator 400. For this, the panel current limiter 350 includes an input data gain value generator 351, a frame current limit gain value generator 352, a sub-frame current generator 353, a sub-frame current selector 354, and a panel current limit gain value generator 355.

The input data gain value generator 351 generates an input data gain value (G1) for controlling the luminance properties corresponding to the input data (RGB) of one frame analyzes the input data (RGB) of one frame through the use of memory device. For this, the input data gain value generator 351 includes a data separator 351*a*, an average image level calculator 351*b*, and an input data gain value calculator 351*c*.

The data separator 351*a* separates the input data (RGB) of each unit pixel input by each frame unit into luminance component (Y) and chrominance component (CbCr); and supplies the separated luminance component (Y) of each unit pixel to the average image level calculator 351*b*.

The average image level calculator 351*b* calculates an average picture level (APL) by averaging the luminance component (Y) of each unit pixel for one frame supplied from the data separator 351*a*; and supplies the calculated average picture level (APL) to the input data gain value calculator 351*c*.

The input data gain value calculator 351*c* calculates the input data gain value (G1) on the basis of the average picture level (APL) supplied from the average image level calculator 351*b*. The input data gain value calculator 351*c* may comprise Look-Up-Table which is mapped with the input data gain value (G1) obtained by pretests based on the average picture level (APL).

For the above description, the input data gain value generator 351 calculates the average picture level (APL) from the luminance component (Y) of the input data (RGB), but not necessarily. The average picture level (APL) may be calculated in generally-known various image-analyzing methods such as histogram according to 3-color input data, 3-color conversion data, 4-color conversion data or input data (RGB) of frame.

The frame current limit gain value generator 352 calculates a frame current limit gain value (G2), which controls the panel current value flowing in the display panel 110 according to the conversion data (DATA) of the frame unit to be lower than the preset current limit value, by the use of conversion data (DATA) of the frame unit supplied from the data processor 330 and input data gain value (G1) supplied from the input data gain value generator 351. For this, the frame current limit gain value generator 352 includes a frame current calculator 352*a* and a frame current limit gain value calculator 352*b*.

The frame current calculator 352*a* reflects the input data gain value (G1) on the conversion data (DATA) to be supplied to each pixel (P) of the display panel 110 for one frame; and predicts the panel current value flowing in the display panel 110 according to the conversion data (DATA) on which the input data gain value (G1) is reflected, to thereby generate a frame current value (FC). In this case, the frame current calculator 352*a* may reflect the input data gain value (G1) on the conversion data (DATA) by multiplying the conversion data (DATA) to be supplied to each pixel (P) by the input data gain value (G1).

The frame current limit gain value calculator 352*b* calculates the frame current limit gain value (G2) on the basis of the frame current value (FC) supplied from the frame current calculator 352*a*. The frame current limit gain value calculator 352*b* may comprise Look-Up-Table which is mapped with the frame current limit gain value (G2) according to the frame current value (FC) obtained by pretests for setting the frame current limit gain value (G2) so as to make the panel current value flowing in the display panel 110 according to the frame current value (FC) be lower than the preset current limit value.

The sub-frame current generator 353 divides one frame into the plurality of sub-frames displayed with the data of the preceding and current frames according to the vertical synchronous signal (Vsync); and predicts the panel current value flowing in the display panel 110 every sub-frame by analyzing the data of the preceding and current frames for each sub-frame, to thereby calculate a plurality of sub-frame current prediction values (SFCi). That is, the sub-frame current generator 353 predicts each region current value by analyzing the data of the preceding frame supplied to some of the division regions on the display panel 110 for each sub-frame, and the data of the current frame to be supplied to the remaining division regions; and calculates the plurality of sub-frame current prediction values (SFCi) according to the predicted region current values. For the following description, it is assumed that one frame is divided into the first to eighth sub-frames, and the display panel 110 is divided into the first to eighth division regions. For this, the sub-frame current generator 353 includes a region current predictor 353*a* and a sub-frame current calculator 353*b*.

Figure 5:
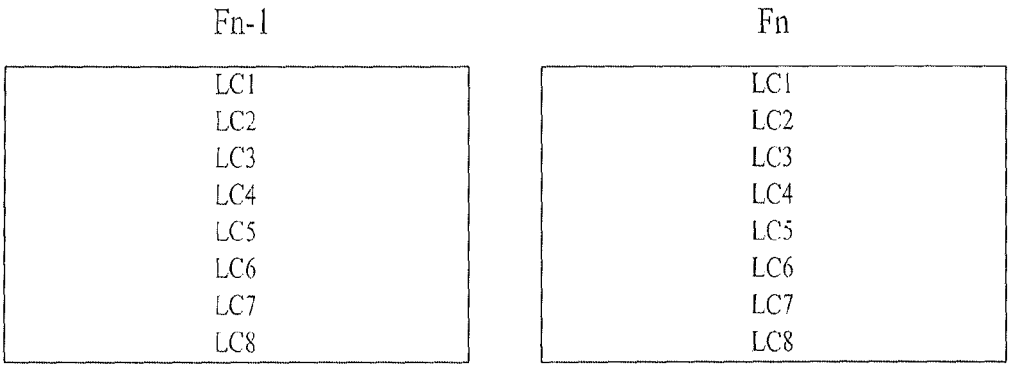
FIG. 5 illustrates a process of generating a plurality of sub-frame current prediction values in a sub-frame current generator shown in FIG. 4.

The region current predictor 353*a* reflects the input data gain value (G1) supplied from the input data gain value generator 351 on the conversion data (DATA) to be supplied to the respective division regions of the display panel 110; and predicts the current value flowing in each of the first to eighth division regions of the display panel 110 according to the conversion data (DATA) on which the input data gain value (G1 is reflected, to thereby generate a plurality of region current prediction values (LCi). In this case, as shown in FIG. 5, the region current prediction value (LCi) is stored in a memory according to each frame unit, and the region current prediction value (LC1 to LC8) of the preceding frame (Fn−1) and the region current prediction value (LC1 to LC8) of the current frame (Fn) are stored in the memory.

The sub-frame current calculator 353*b* predicts the panel current value flowing in the display panel 110 every sub-frame by the use of region current prediction values (LCi) of the preceding and current frames stored in the memory, to thereby generate the plurality of sub-frame current prediction values (SFCi).

In more detail, the sub-frame current calculator 353*b* adds the region current value predicted from the data of the preceding frame displayed in some division regions among the first to eighth division regions to the region current prediction value predicted from the data of the current frame to be displayed in the remaining division regions among the first to eighth division regions every sub-frame, whereby the first to eighth sub-frame current prediction values (SFC1 to SFC8) are generated as shown in the following Table 1.

TABLE 1

| | Fn − 1 | Fn |
|---|---|---|
| SFC1 | LC2 + LC3 + LC4 + LC5 + LC6 + LC7 + LC8+ | LC1 |
| SFC2 | LC3 + LC4 + LC5 + LC6 + LC7 + LC8+ | LC1 + LC2 |
| SFC3 | LC4 + LC5 + LC6 + LC7 + LC8+ | LC1 + LC2 + LC3 |
| SFC4 | LC5 + LC6 + LC7 + LC8+ | LC1 + LC2 + LC3 + LC4 |
| SFC5 | LC6 + LC7 + LC8+ | LC1 + LC2 + LC3 + LC4 + LC5 |
| SFC6 | LC7 + LC8+ | LC1 + LC2 + LC3 + LC4 + LC5 + LC6 |
| SFC7 | LC8+ | LC1 + LC2 + LC3 + LC4 + LC5 + LC6 + LC7 |
| SFC8 | | LC+1 + LC2 + LC3 + LC4 + LC5 + LC6 + LC7 + LC8 |

As shown in the above Table 1, each of the first to eighth sub-frame current prediction values (SFC1 to SFC8) is generated by addition of the corresponding region current prediction values of the preceding frame (Fn−1) and the current frame (Fn) simultaneously displayed on the display panel 110 according to the data addressing order. For example, the first sub-frame current prediction value (SFC1) is generated by adding the current prediction value (LC1) of the first division region of the current frame (Fn) to the current prediction values (LC2 to LC8) of the second to eighth division regions of the preceding frame (Fn−1) stored in the memory. Also, the second sub-frame current prediction value (SFC2) is generated by adding the current prediction values (LC1, LC2) of the first and second division regions of the current frame (Fn) to the current prediction values (LC3 to LC8) of the third to eighth division regions of the preceding frame (Fn−1) stored in the memory. However, the eighth sub-frame current prediction value (SFC8) is generated by adding the current prediction values (LC1 to LC8) of the first to eighth division regions of the current frame (Fn) together.

Referring once again to FIG. 4, the sub-frame current selector 354 selects the largest sub-frame current prediction value as a sub-frame maximum current value (MC) among the plurality of sub-frame current prediction values (SFCi) supplied from the aforementioned sub-frame current generator 353; and then supplies the sub-frame maximum current value (MC) to the panel current limit gain value generator 355.

The panel current limit gain value generator 355 generates the panel current limit gain value (PCLG) so as to make the panel current flowing in the display panel 110 be lower than the preset current limit value on the basis of the preset current limit value and the sub-frame maximum current value (MC) supplied from the sub-frame current selector 354; and then supplies the generated panel current limit gain value (PCLG) to the reference gamma voltage generator 400. That is, the panel current limit gain value generator 355 compares the sub-frame maximum current value (MC) with the preset current limit value; and then generates the panel current limit gain value (PCLG) by bypassing the frame current limit gain value (G2) supplied from the aforementioned frame current limit gain value generator 352, or generates the panel current limit gain value (PCLG) by correcting the frame current limit gain value (G2) on the basis of the sub-frame maximum current value (MC). For this, the panel current limit gain value generator 355 includes a comparer 355*a*, a first gain value generator 355*b*, and a second gain value generator 355*c*.

The comparer 355*a* compares the sub-frame maximum current value (MC) with the current limit value; and generates a comparing signal (CS) selectively provided with first or second logic state according to the comparison result, wherein the first and second logic states are different from each other. For example, if the sub-frame maximum current value (MC) is smaller than the preset current limit value, the comparer 355*a* generates the comparing signal (CS) of the first logic state. Meanwhile, if the sub-frame maximum current value (MC) is larger than the preset current limit value, the comparer 355*a* generates the comparing signal (CS) of the second logic state.

If the comparing signal (CS) of the first logic state is supplied from the comparer 355*a* to the first gain value generator 355*b*, the first gain value generator 355*b* generates the panel current limit gain value (PCLG) by bypassing the frame current limit gain value (G2); and supplies the generated panel current limit gain value (PCLG) to the reference gamma voltage generator 400.

If the comparing signal (CS) of the second logic state is supplied from the comparer 355*a* to the second gain value generator 355*c*, the second gain value generator 355*c* extracts the current value of the preceding frame displayed on the display panel 110; and corrects the frame current limit gain value (G2) so as to make the current value by the data of the current frame be a differential current value between the current limit value and the current value of the preceding frame on the basis of the current value of the preceding frame and the current limit value, to thereby generate the panel current limit gain value (PCLG).

The second gain value generator 355*c* extracts the current value of the current frame by the data of the current frame to be displayed on the display panel 110 from the region current prediction value (LCi) of the current frame stored in the memory; and extracts the current value of the preceding frame which corresponds to the current value obtained by subtracting the current value of the current frame from the sub-frame maximum current value (MC).

If the extracted current frame of the preceding frame is the same as or larger than the current limit value, the second gain value generator 355*c* generates the panel current limit gain value (PCLG) by correcting the frame current limit gain value (G2) so as to make the current value flowing in the remaining division regions be 0 (zero) according to the data of the current frame to be displayed in the remaining division regions of the display panel 110; and supplies the generated panel current limit gain value (PCLG) to the reference gamma voltage generator 400. In this case, the panel current limit gain value (PCLG) is generated to have the value of 0 (zero); and the reference gamma voltage generator 400 generates the plurality of reference gamma voltages (RGV) having the voltage level of 0 (zero), and then supplies them to the aforementioned data driver 132, whereby the data voltage (Vdata) supplied to the remaining division regions of the display panel 110 to be displayed with the data of the current frame has the voltage level of 0 (zero). Accordingly, a black image is displayed on the remaining division regions of the display panel 110 to be displayed with the data of the current frame.

If the extracted current value of the preceding frame is smaller than the current limit value, the second gain value generator 355*c* generates a current correction value of the current frame by the current limit value, the extracted current value of the preceding frame, and the extracted current value of the current frame. In this case, as shown in the following Equation 1, the second gain value generator 355*c* may generate the current correction value (α) of the current frame by dividing a differential current value ($C_{Lim}-_{Fn-1}$), which is obtained by subtracting the extracted current value ($C_{Fn-1}$) of the preceding frame from the current limit value ($C_{Lim}$), by the extracted current value ($C_{Fn}$) of the current frame.

$$\alpha = \left(\frac{C_{Lim} - C_{Fn-1}}{C_{Fn}}\right) \quad \text{[Equation 1]}$$

The second gain value generator 355*c* generates the panel current limit gain value (PCLG) by reflecting the current correction value (α) of the current frame on the frame current limit gain value (G2), that is, by multiplying the current correction value (α) of the current frame by the frame current limit gain value (G2); and supplies the generated panel current limit gain value (PCLG) to the reference gamma voltage generator 400. In this case, the reference gamma voltage generator 400 generates the plurality of reference gamma voltages (RGV) according to the panel current limit gain value (PCLG); and supplies the plurality of reference gamma voltages (RGV) to the aforementioned data driver 132. Also, the data driver 132 converts the data of the current frame into the data voltage (Vdata) by the use of reference gamma voltages (RGV); and displays the data voltage (Vdata) on the remaining division regions of the display panel 110. Accordingly, the current flowing in the display panel 110 is controlled by the preset current limit value determined based on the data voltage of the current frame which is converted from the plurality of reference gamma voltage (RGV) controlled according to the panel current limit gain value (PCLG).

Meanwhile, the aforementioned sub-frame current generator 353 re-reflects the panel current limit gain value (PCLG), which feed backs from the panel current limit gain value generator 355, on the conversion data (DATA) of the current frame; reproduces the region current prediction value by predicting the current value flowing in each region of the first to eighth division regions of the display panel 110 according to the conversion data (DATA) of the current frame on which the panel current limit gain value (PCLG) is reflected; re-calculates the plurality of sub-frame current prediction values by the use of region current prediction values of the preceding and current frames; and detects whether or not the re-calculated sub-frame current prediction value is higher than the preset current limit value.

As described above, the timing controller 300 according to the first embodiment of the present invention calculates the panel current limit gain value (PCLG) so as to make the panel current value, which flows in the display panel 110 every sub-frame on the basis of the input data (RGB) and the conversion data (DATA) converted from the input data (RGB), be lower than the preset current limit value; and generates the plurality of reference gamma voltages (RGV) according to the calculated panel current limit gain value (PCLG), whereby the panel current value flowing in the display panel 110 is controlled to be lower than the preset current limit value.

Figure 6:
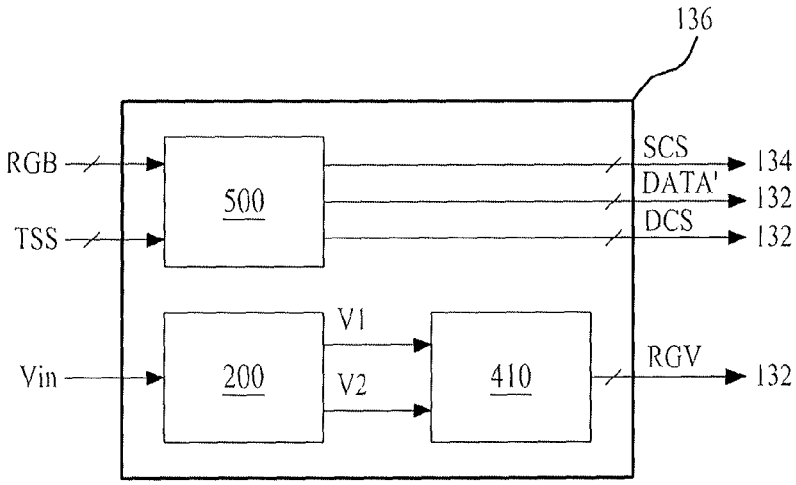
FIG. 6 is a block diagram illustrating a controller, shown in FIG. 2, according to the second embodiment of the present invention.
Figure 7:
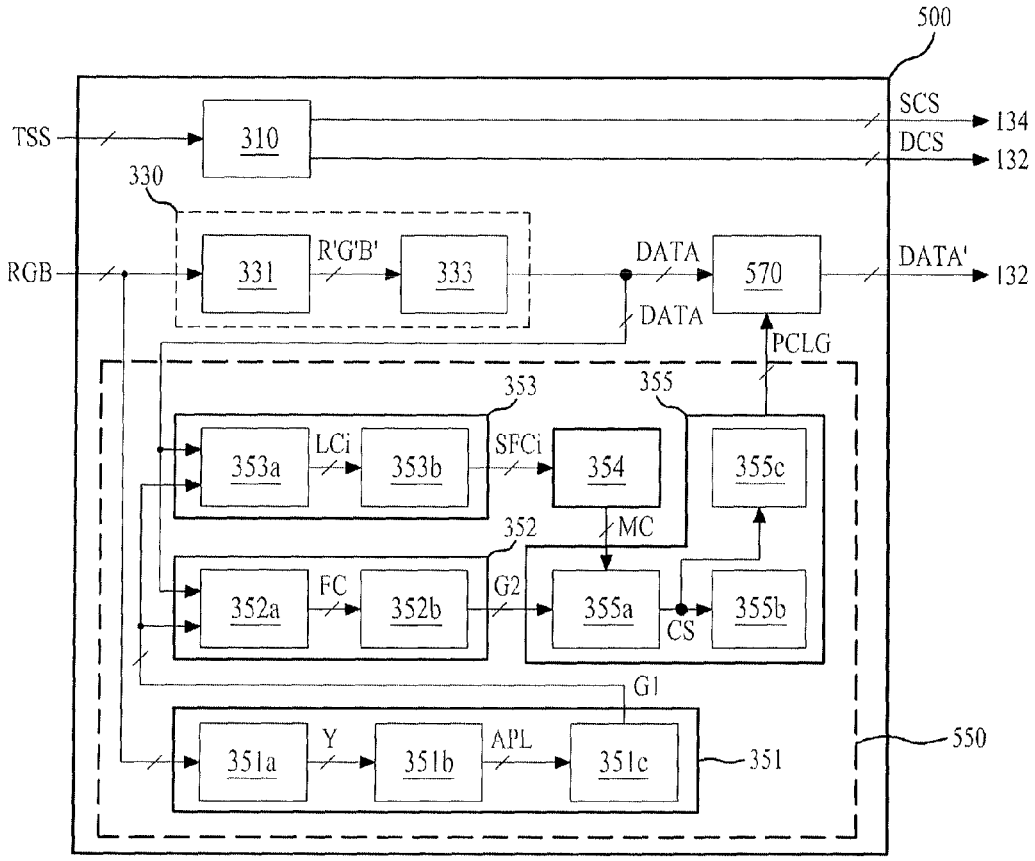
FIG. 7 is a block diagram illustrating a timing controller, shown in FIG. 6, according to the second embodiment of the present invention.

FIG. 6 is a block diagram illustrating a controller, shown in FIG. 2, according to the second embodiment of the present invention. FIG. 7 is a block diagram illustrating a timing controller, shown in FIG. 6, according to the second embodiment of the present invention.

Referring to FIGS. 6 and 7, a controller 136 according to the second embodiment of the present invention generates a panel current limit gain value (PCLG) which controls a panel current value flowing in a display panel 110 be lower than a preset current limit value on the basis of input data (RGB) of preceding and current frames and conversion data (DATA) of the preceding and current frames; and generates correction data (DATA') by correcting the conversion data (DATA) according to the panel current limit gain value (PCLG). The controller 136 according to the second embodiment of the present invention generates a data control signal (DCS) and a scanning control signal (SCS) on the basis of timing synchronous signal (TSS); supplies the data control signal (DCS) to a data driver 132; and supplies the scanning control signal (SCS) to a scanning driver 134. For this, the controller 136 according to the second embodiment of the present invention includes a power supplier 200, a reference gamma voltage generator 410, and a timing controller 500.

The power supplier 200 generates and outputs various driving voltages for displaying the image on the display panel 110 by the use of input power (Vin) supplied from the external.

The reference gamma voltage generator 410 determines voltage levels of first and second driving voltages (V1, V2) for generating gamma voltages from the power supplier 200; divides the first and second driving voltages (V1, V2) into predetermined voltage levels; and supplies the plurality of reference gamma voltages (RGV) generated differently from one another to the data driver 132. Unlike the reference gamma voltage generator 400 of the controller 136 according to the first embodiment of the present invention, the reference gamma voltage generator 410 of the controller 136 according to the second embodiment of the present invention generates the plurality of reference gamma voltages (RGV), which are different from one another, regardless of a current limit gain value (CLG).

The reference gamma voltage generator 410 according to one embodiment of the present invention generates a plurality of common reference gamma voltages (RGV) which are applied in common to convert the input data (RGB) of red, green and blue colors into the data voltage (Vdata).

The reference gamma voltage generator 400 according to another embodiment of the present invention may generate a plurality of red reference gamma voltages, a plurality of green reference gamma voltages, and a plurality of blue reference gamma voltages which are separately (or individually) applied to convert the input data (RGB) of red, green and blue colors into the separate (or individual) data voltage (Vdata).

Further, if a unit pixel of the display panel 100 comprises the red pixel, green pixel, blue pixel and white pixel, the reference gamma voltage generator 410 according to another embodiment of the present invention may generate the plurality of red, green, blue and white reference gamma voltages, which are respectively set in different voltage levels.

The aforementioned reference gamma voltage generator 410 may be realized in a programmable gamma integrated circuit (programmable gamma IC) for generating the plurality of reference gamma voltages (RGV) which are different from one another, or may be realized in at least one voltage-dividing resistance row, provided with a plurality of resistances, and a plurality of nodes respectively interposed between each of the resistances, for outputting the plurality of reference gamma voltages (RGV) which are different from one another.

The timing controller 500 according to the second embodiment of the present invention generates the data control signal (DCS) and the scanning control signal (SCS) on the basis of the timing synchronous signal (TSS); and controls the aforementioned data driver 132 and the scanning driver 134. Also, the timing controller 500 generates the conversion data (DATA) by converting the input data (RGB) of frame unit to be appropriate for the display panel 110; and generates the panel current limit gain value (PCLG) so as to make the panel current value flowing in the display panel 110 be lower than the preset current limit value on the basis of the input data (RGB) of preceding and current frames and conversion data (DATA) of the preceding and current frames. Also, the timing controller 500 generates the correction data (DATA') by correcting the conversion data (DATA) according to the panel current limit gain value (PCLG); and supplies the generated correction data (DATA') to the data driver 132. That is, the timing controller 500 generates the correction data (DATA') so as to make the panel current value flowing in the display panel 110 be lower than the preset current limit value according to the aforementioned panel current limit gain value (PCLG); and then supplies the generated correction data (DATA') to the data driver 132. For this, the timing controller 500 according to the second embodiment of the present invention includes a control signal generator 310, a data processor 330, a panel current limiter 350, and a data corrector 570.

The control signal generator 310 and the data processor 330 are identical in structure to those of the timing controller 300, shown in FIG. 4, according to the first embodiment of the present invention, whereby a detailed explanation for the same parts will be omitted.

Except that the panel current limit gain value (PCLG) generated in a panel current limit gain value generator 355 of the panel current limiter 350 is not supplied to the reference gamma voltage generator 410, but supplied to the data corrector 570, the panel current limiter 550 is identical in structure to the panel current limiter 350 of the timing controller 300 according to the first embodiment of the present invention shown in FIG. 4, whereby a detailed explanation for the panel current limiter 550 will be substituted by the aforementioned description of FIG. 4.

The data corrector 570 generates the correction data (DATA') by correcting the conversion data (DATA) supplied from the data processor 330 by the use of panel current limit gain value (PCLG) supplied from the panel current limiter 550. For example, the data corrector 570 may generate the correction data (DATA') by multiplying the conversion data (DATA) to be supplied to each pixel (P) by the panel current limit gain value (PCLG).

The controller 136 according to the second embodiment of the present invention calculates the panel current limit gain value (PCLG) on the basis of the input data (RGB) of the preceding and current frames; and generates the correction data (DATA') according to the calculated panel current limit gain value (PCLG), so that it is possible to make the panel current value flowing in the display panel 110 be lower than the preset current limit value.

Figure 8:
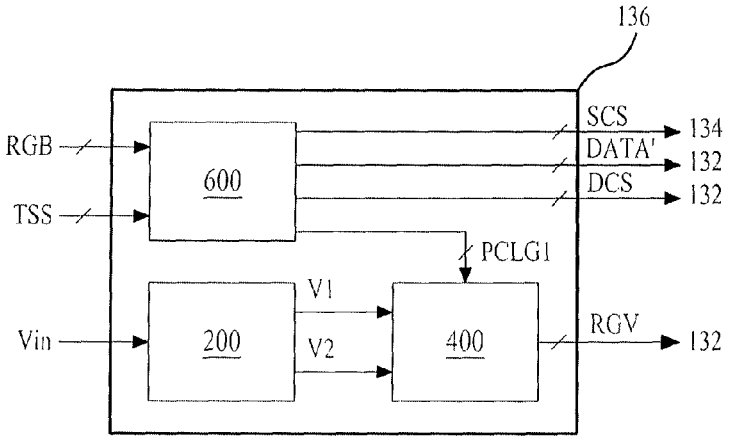
FIG. 8 is a block diagram illustrating a controller, shown in FIG. 2, according to the third embodiment of the present invention.
Figure 9:
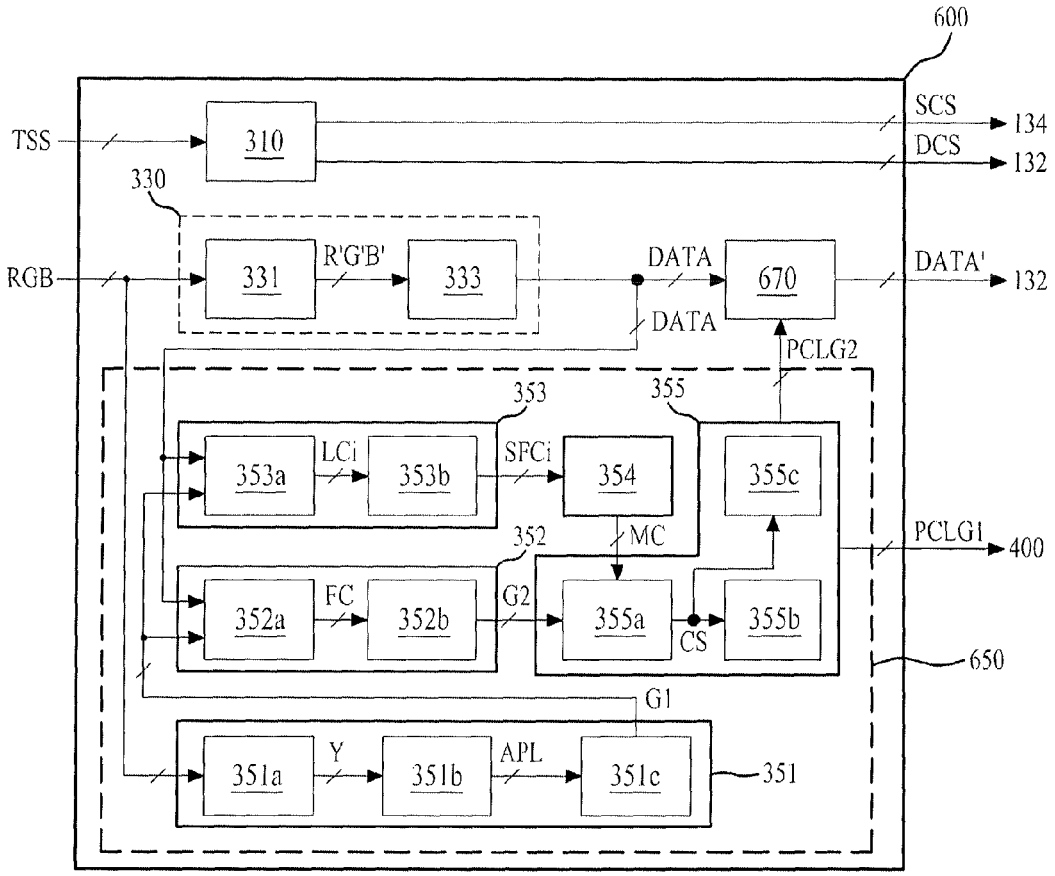
FIG. 9 is a block diagram illustrating a timing controller, shown in FIG. 8, according to the third embodiment of the present invention.

FIG. 8 is a block diagram illustrating a controller, shown in FIG. 2, according to the third embodiment of the present invention. FIG. 9 is a block diagram illustrating a timing controller, shown in FIG. 8, according to the third embodiment of the present invention.

Referring to FIGS. 8 and 9, a controller 136 according to the third embodiment of the present invention generates a panel current limit gain value (PCLG) which controls a panel current value flowing in a display panel 110 to be lower than a preset current limit value on the basis of input data (RGB) of preceding and current frames and conversion data (DATA) of the preceding and current frames; and generates a plurality of reference gamma voltages (RGV) by the use of generated panel current limit gain value (PCLG), and simultaneously generates correction data (DATA') by correcting the conversion data (DATA). Also, the controller 136 according to the third embodiment of the present invention generates a data control signal (DCS) and a scanning control signal (SCS) on the basis of timing synchronous signal (TSS); supplies the data control signal (DCS) to a data driver 132; and supplies the scanning control signal (SCS) to a scanning driver 134. For this, the controller 136 according to the third embodiment of the present invention includes a power supplier 200, a reference gamma voltage generator 400, and a timing controller 600.

The power supplier 200 generates and outputs various driving voltages for displaying the image on the display panel 110 by the use of input power (Vin) supplied from the external.

The timing controller 600 according to the third embodiment of the present invention generates the aforementioned data control signal (DCS) and the scanning control signal (SCS) on the basis of the timing synchronous signal (TSS); and controls the driving for each of the data driver 132 and the scanning driver 134. Also, the timing controller 600 generates the conversion data (DATA) by converting the input data (RGB) of frame unit to be appropriate for the display panel 110; and generates the panel current limit gain value (PCLG) so as to make the panel current value flowing in the display panel 110 be lower than the preset current limit value on the basis of the input data (RGB) of preceding and current frames and conversion data (DATA) of the preceding and current frames. Also, the timing controller 600 generates a panel current limit gain value (PCLG1) for a gamma voltage and a panel current limit gain value (PCLG2) for data by dividing the panel current limit gain value (PCLG) according to a preset proportion; and generates correction data (DATA') by correcting the conversion data (DATA) by the use of panel current limit gain value for data. That is, the timing controller 600 generates the correction data (DATA') so as to make the panel current value flowing in the display panel 110 be lower than the preset current limit value according to the aforementioned panel current limit gain value (PCLG); and then supplies the generated correction data (DATA') to the data driver 132. For this, the timing controller 600 according to the third embodiment of the present invention includes a control signal generator 310, a data processor 330, a panel current limiter 650, and a data corrector 670.

The control signal generator 310 and the data processor 330 are identical in structure to those of the timing controller 300, shown in FIG. 4, according to the first embodiment of the present invention, whereby a detailed explanation for the same parts will be omitted.

The panel current limit 650 is identical in structure to the panel current limiter 350 of the timing controller 300 according to the first embodiment of the present invention. However, as mentioned above, a panel current limit gain value calculator 355 of the panel current limiter 650 generates the panel current limit gain value (PCLG); generates the panel current limit gain value (PCLG1) for the gamma voltage and the panel current limit gain value (PCLG2) for data by dividing the panel current limit gain value (PCLG) according to the preset proportion; and supplies the panel current limit gain value (PCLG1) for the gamma voltage to the reference gamma voltage generator 400, and simultaneously supplies the panel current limit gain value (PCLG2) for data to the data corrector 670.

The data corrector 670 generates the correction data (DATA') by correcting the conversion data (DATA) supplied from the data processor 330 by the use of panel current limit gain value (PCLG2) for data supplied from the panel current limiter 650. For example, the data corrector 670 may generate the correction data (DATA') by multiplying the conversion data (DATA) to be supplied to each pixel (P) by the panel current limit gain value (PCLG2) for data.

Except that the plurality of reference gamma voltage (RGV) are generated by the use of panel current limit gain value (PCLG1) for the gamma voltage supplied from the timing controller 600, and then supplied to the data driver 132, the reference gamma voltage generator 400 of the controller 136 according to the third embodiment of the present invention is identical in structure to the reference gamma voltage generator 400 of the controller 136 according to the first embodiment of the present invention, whereby the same reference number is used therein, and a detailed explanation for the reference gamma voltage generator 400 will be substituted by the aforementioned description.

The controller 136 according to the third embodiment of the present invention calculates the panel current limit gain value (PCLG) on the basis of input data (RGB) of the preceding and current frames; and generates the correction data (DATA') according to the calculated panel current limit gain value (PCLG), and generates the plurality of reference gamma voltage (RGV), so that it is possible to make the panel current value flowing in the display panel 110 be lower than the preset current limit value.

Figure 10:
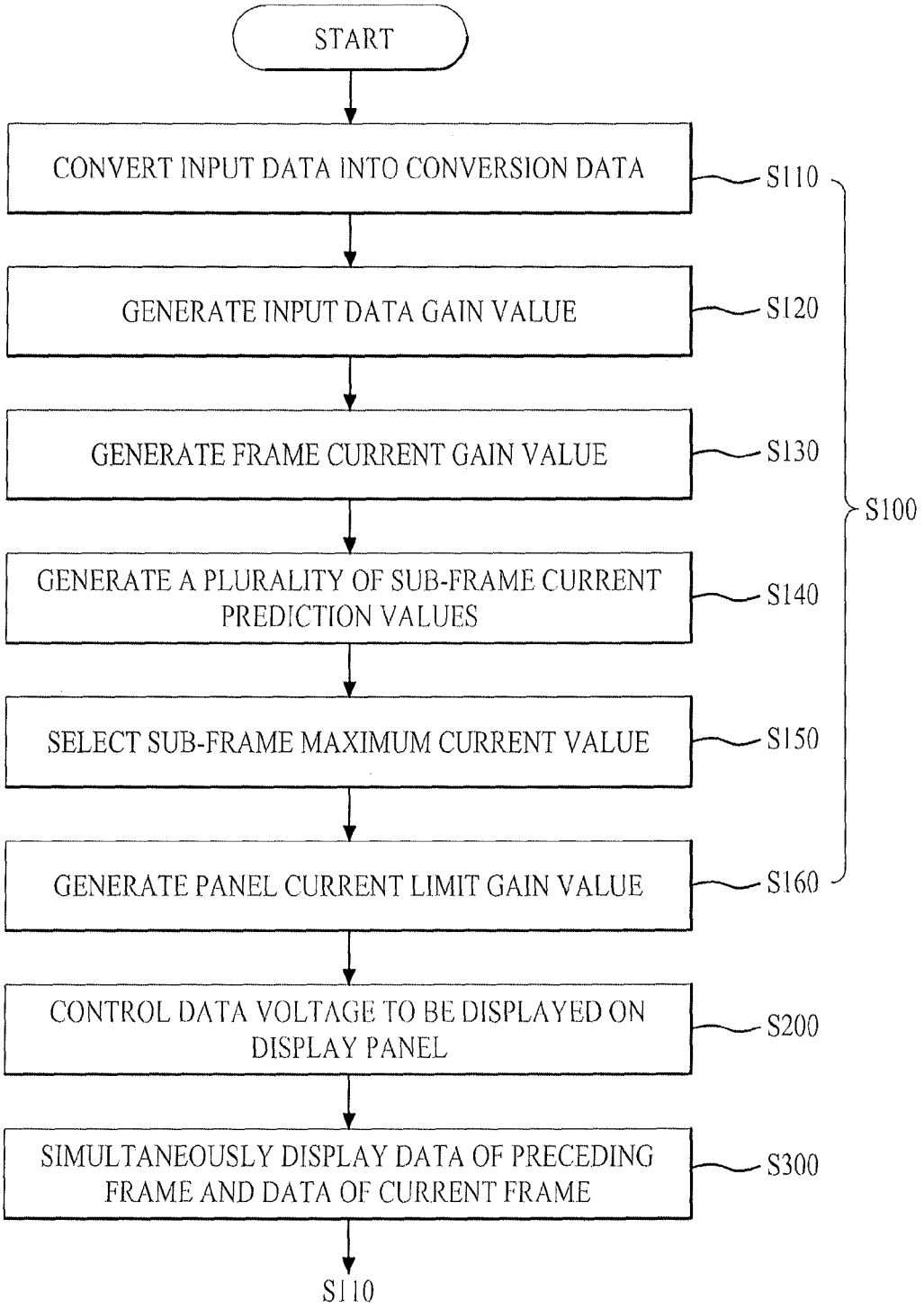
FIG. 10 is a flow chart illustrating a method for driving the organic light emitting display device according to the embodiment of the present invention.
Figure 11:
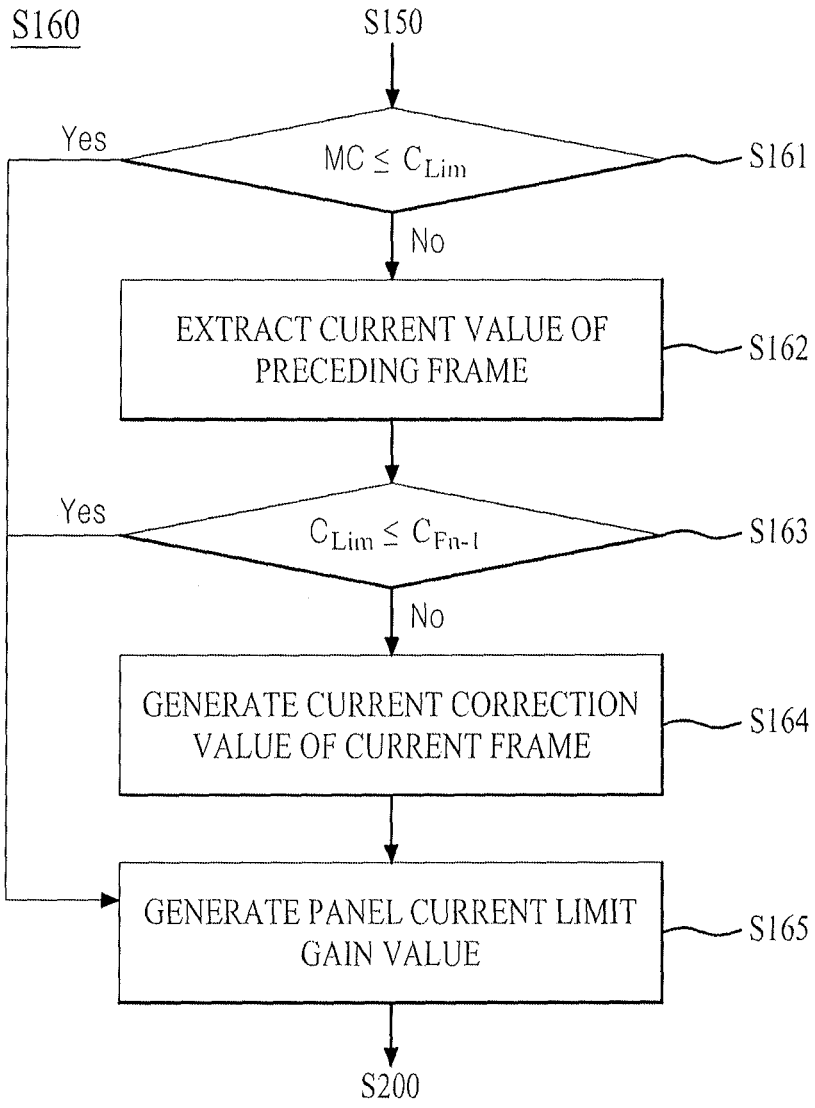
FIG. 11 is a flow chart illustrating a process of generating a panel current limit gain value shown in FIG. 10.

FIG. 10 is a flow chart illustrating a method for driving the organic light emitting display device according to the embodiment of the present invention. FIG. 11 is a flow chart illustrating a process for generating the panel current limit gain value shown in FIG. 10.

A method for driving the organic light emitting display device according to the embodiment of the present invention will be described with reference to FIGS. 10 and 11 in connection with FIG. 2.

First, the panel current value flowing in the display panel 110 is predicted from the data of the preceding frame and the data of the current frame simultaneously displayed on the display panel 110 (S100).

Then, the data voltage to be displayed on the display panel 110 is controlled to make the predicted panel current value be lower than the preset current limit value (S200).

Thereafter, the data of the preceding frame and the data of the current frame are simultaneously displayed on the display panel 110 by the controlled data voltage (S300).

The above process (S100) for predicting the panel current value flowing in the display panel 110 will be described in detail as follows.

The process (S100) for predicting the panel current value flowing in the display panel 110 is performed in the panel current limiter 350, 550 or 650 shown in FIG. 4, FIG. 7 or FIG. 9, wherein a detailed explanation for the panel current limiter 350, 550 or 650 will be substituted by the above description. Hereinafter, the process (S100) for predicting the panel current value flowing in the display panel 110 will be briefly described as follows. The process (S100) for predicting the panel current value flowing in the display panel 110 includes generating the conversion data (DATA) by aligning the input data (RGB) (S110); generating the input data gain value (G1) for controlling the luminance properties for the input data (RGB) of frame unit by analyzing the input data (RGB) of one frame (S120); generating the frame current limit gain value (G2) for making the current value flowing in the display panel 110 be lower than the current limit value according to the conversion data (DATA) of frame unit by the use of conversion data (DATA) of one frame and input data gain value (G1) (S130); generating the plurality of sub-frame current prediction values (SFCi) by dividing one frame into the plurality of sub-frames displayed with the data of the preceding and current frames, and predicting the current value flowing in the display panel 110 every sub-frame through analysis of the conversion data of the preceding and current frames for each sub-frame (S140); selecting the largest sub-frame current prediction value as the sub-frame maximum current value (MC) among the plurality of sub-frame current prediction values (SFCi) (S150); and predicting the panel current value flowing in the display panel 110 every sub-frame on the basis of the sub-frame maximum current value (MC) and the current limit value, and generating the panel current limit gain value (PCLG) so as to make the panel current value be lower than the current limit value (S160).

The above process (S140) for generating the plurality of sub-frame current prediction values (SFCi) is performed in the sub-frame current generator 353 of the panel current limiter 350, 550 or 650 shown in FIG. 4, FIG. 7 or FIG. 9. The process (S140) for generating the plurality of sub-frame current prediction values (SFCi) includes predicting the plurality of region current prediction value (LCi) for the respective division regions by analyzing the conversion data to be supplied to the plurality of division regions of the display panel 110 on the basis of the conversion data of frame unit by the use of conversion data of one frame and input data gain value (G1); and calculating each sub-frame current prediction value (SFCi) by adding the region current prediction value of the current frame predicted based on the data of the current frame to the region current prediction value of the preceding frame predicted based on the data of the preceding frame from the plurality of region current prediction values (LCi) every sub-frame.

The panel current limit gain value (PCLG) is generated in the panel current limit gain value generator 355 of the panel current limiter 350, 550 or 650 shown in FIG. 4, FIG. 7 or FIG. 9. Referring to FIG. 11, the process for generating the panel current limit gain value (PCLG) will be described in detail as follows.

First, the sub-frame maximum current value (MC) is compared with the current limit value ($C_{Lim}$) (S161). Based on the comparison result of S161, if the current limit value ($C_{Lim}$) is smaller than the sub-frame maximum current value (MC) (that is, "NO" of S161), the current value of the preceding frame displayed on the display panel 110 is extracted (S162), and the current value ($C_{Fn-1}$) of the preceding frame is compared with the current limit value ($C_{Lim}$) (S163). Then, based on the comparison result of S163, if the current value ($C_{Fn-1}$) of the preceding frame is smaller than the current limit value ($C_{Lim}$) (that is, "NO" of S163), the current correction value ($\alpha$) of the current frame is generated so as to make the current value by the data of the current frame be the differential current value between the current limit value ($C_{Lim}$) and the current value ($C_{Fn-1}$) of the preceding frame through the above Equation 1 (S164), and the frame current limit gain value (G2) is corrected according to the current correction value ($\alpha$) of the current frame, to thereby generate the panel current limit gain value (PCLG) (S165).

Based on the comparison result of S161, if the current limit value ($C_{Lim}$) is the same as or larger than the sub-frame maximum current value (MC) (that is, "YES" of S161), the panel current limit gain value (PCLG) is generated by bypassing the frame current limit gain value (G2) (S165).

Based on the comparison result of S163, if the current value ($C_{Fn-1}$) of the preceding frame is the same as or larger than the current limit value ($C_{Lim}$) (that is, "YES" of S163), the frame current limit gain value (G2) is corrected so as to make the current value flowing in the remaining regions be 0 (Zero) according to the data of the current frame to be displayed in the remaining division regions of the display panel 110 (S165). In this case, the panel current limit gain value (PCLG) may be 0 (Zero).

The process (S200) for controlling the data voltage to be displayed on the display panel 110 so as to make the predicted panel current value be lower than the preset current limit value will be described in detail as follows.

As described above, the data voltage (Vdata) to be displayed on the display panel 110 may be controlled by at least one of the plurality of reference gamma voltages and the data of the current frame according to the panel current limit gain value (PCLG).

According to one embodiment of the present invention, the process (S200) for controlling the data voltage to be displayed on the display panel 110 may include generating the plurality of reference gamma voltages corresponding to the panel current limit gain value (PCLG); and converting the conversion data of the current frame into the data voltage by the use of reference gamma voltages.

According to another embodiment of the present invention, the process (S200) for controlling the data voltage to be displayed on the display panel 110 may include generating the plurality of reference gamma voltages; generating the correction data by correcting the conversion data of the current frame according to the panel current limit gain value (PCLG); and converting the correction data into the data voltage by the use of reference gamma voltages.

According to another embodiment of the present invention, the process (S200) for controlling the data voltage to be displayed on the display panel 110 may include generating the plurality of reference gamma voltages corresponding to the panel current limit gain value (PCLG); generating the correction data by correcting the conversion data of the current frame according to the panel current limit gain value (PCLG); and converting the correction data into the data voltage by the use of reference gamma voltages.

Accordingly, the apparatus and method for driving the organic light emitting display device according to the embodiment of the present invention controls the current value flowing in the display panel 110 to be lower than the preset limit value on the basis of the input data (RGB) of the preceding and current frames, so that it is possible to prevent shut-down of the power supplier and screen error caused by the overcurrent momentarily flowing in the display panel 110 according to the image of the preceding and current frames, and further to improve reliability of apparatus (or product).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving an organic light emitting display device comprising:

a display panel including a plurality of pixels, wherein each pixel is provided with a light emitting device which emits light according to a current corresponding to a data voltage; and a panel driver that predicts a panel current value flowing in the display panel on the basis of data of a preceding frame and data of a current frame simultaneously displayed on the display panel, and controls the data voltage used in displaying images on the display panel so as to make the panel current value be lower than a preset current limit value.

2. The apparatus according to claim 1, wherein the panel driver divides one frame into a plurality of sub-frames simultaneously displayed with the data of the preceding frame and the data of the current frame; predicts a panel current value for each sub-frame from the data of the preceding and current frames for each sub-frame; and controls the data voltage of the current frame every sub-frame so as to make the panel current value of each sub-frame be lower than the current limit value.

3. The apparatus according to claim 1, wherein the panel driver divides a display area of the display panel into a plurality of division regions; predicts the panel current value from the data of the preceding frame displayed in some of the division regions and the data of the current frame to be displayed in the remaining division regions; and controls the data voltage of the current frame so as to make the predicted panel current value be lower than the preset current limit value.

4. The apparatus according to claim 1, wherein the panel driver comprises:

a controller which generates conversion data by converting input data, generates a panel current limit gain value so as to make the panel current value be lower than the current limit value by analyzing the input data and conversion data of the preceding and current frames, and generates a plurality of reference gamma voltages according to the panel current limit gain value;

a scanning driver which supplies a scanning signal to each pixel; and a data driver which converts the conversion data into the data voltage by the use of reference gamma voltages, and supplies the data voltage to each pixel.

5. The apparatus according to claim 4, wherein the controller includes a panel current limiter that generates the panel current limit gain value, wherein the panel current limiter comprises:

an input data gain value generator which generates an input data gain value for controlling the luminance properties for the input data of frame unit by analyzing the input data of one frame;

a frame current limit gain value generator which generates a frame current limit gain value for controlling the panel current value flowing in the display panel to be lower than the current limit value according to the conversion data of frame unit by the use of conversion data of one frame and input data gain value;

a sub-frame current generator which divides one frame into the plurality of sub-frames simultaneously displayed with the data of the preceding frame and the data of the current frame, and generates a plurality of sub-frame current prediction values by predicting the panel current value flowing in the display panel every sub-frame through analysis of the data of the preceding and current frames for each sub-frame;

a sub-frame current selector which selects the largest sub-frame current prediction value as a sub-frame maximum current value among the plurality of sub-frame current prediction values; and a panel current limit gain value generator which predicts the panel current value flowing in the display panel every sub-frame on the basis of the sub-frame maximum current value and the current limit value, and generates the panel current limit gain value so as to make the panel current value be lower than the current limit value.

6. The apparatus according to claim 5, wherein the sub-frame current generator comprises:

a region current predictor which predicts a region current prediction value for each region of the plurality of division regions by analyzing the conversion data to be supplied to each of the division regions of the display panel on the basis of the conversion data of frame unit by the use of conversion date of one frame and input data gain value; and a sub-frame current calculator which calculates each sub-frame current prediction value by adding the region current prediction value of the preceding frame predicted from the data of the preceding frame to the region current prediction value of the current frame predicted from the data of the current frame among the plurality of region current prediction values every sub-frame.

7. The apparatus according to claim 5, wherein the panel current limit gain value generator comprises:

a comparer which compares the sub-frame maximum current value with the current limit value, and generates a comparing signal of first or second logic state according to the comparison result;

a first gain value generator, if the comparing signal of the first logic state is supplied thereto, which generates the frame current limit gain value as the panel current limit gain value; and a second gain value generator, if the comparing signal of the second logic state is supplied thereto, which extracts the current value of the preceding frame displayed on the display panel, and generates the panel current limit gain value by correcting the frame current limit gain value so as to make the current value by the data of the current frame be a differential current value between the current limit value and the current value of the preceding frame on the bases of the current value of the preceding frame and the current limit value.

8. The apparatus according to claim 1, wherein the panel driver comprises:

a controller which generates conversion data by converting input data, generates a panel current limit gain value so as to make the panel current value be lower than the current limit value by analyzing the input data and conversion data of the preceding and current frames, generates correction data by correcting the conversion data of the current frame according to the panel current limit gain value, and generates a plurality of reference gamma voltages;

a scanning driver which supplies a scanning signal to each pixel; and a data driver which converts the correction data into the data voltage by the use of reference gamma voltages, and supplies the data voltage to each pixel.

9. The apparatus according to claim 8, wherein the controller includes a panel current limiter for generating the panel current limit gain value, wherein the panel current limiter comprises:

an input data gain value generator which generates an input data gain value for controlling the luminance properties for the input data of frame unit by analyzing the input data of one frame;

a frame current limit gain value generator which generates a frame current limit gain value for controlling the panel current value flowing in the display panel to be lower than the current limit value according to the conversion data of frame unit by the use of conversion data of one frame and input data gain value;

a sub-frame current generator which divides one frame into the plurality of sub-frames simultaneously displayed with the data of the preceding frame and the data of the current frame, and generates a plurality of sub-frame current prediction values by predicting the panel current value flowing in the display panel every sub-frame through analysis of the data of the preceding and current frames for each sub-frame;

a sub-frame current selector which selects the largest sub-frame current prediction value as a sub-frame maximum current value among the plurality of sub-frame current prediction values; and a panel current limit gain value generator which predicts the panel current value flowing in the display panel every sub-frame on the basis of the sub-frame maximum current value and the current limit value, and generates the panel current limit gain value so as to make the panel current value be lower than the current limit value.

10. The apparatus according to claim 9, wherein the sub-frame current generator comprises:

a region current predictor which predicts a region current prediction value for each region of the plurality of division regions by analyzing the conversion data to be supplied to each of the division regions of the display panel on the basis of the conversion data of frame unit by the use of conversion date of one frame and input data gain value; and a sub-frame current calculator which calculates each sub-frame current prediction value by adding the region current prediction value of the preceding frame predicted from the data of the preceding frame to the region current prediction value of the current frame predicted from the data of the current frame among the plurality of region current prediction values every sub-frame.

11. The apparatus according to claim 1, wherein the panel driver comprises:

a controller which generates conversion data by converting input data, generates a panel current limit gain value so as to make the panel current value be lower than the current limit value by analyzing the input data and conversion data of the preceding and current frames, and generates a plurality of reference gamma voltages according to the panel current limit gain value, and simultaneously generates correction data by correcting the conversion data of the current frame according to the panel current limit gain value;

a scanning driver which supplies a scanning signal to each pixel; and a data driver which converts the correction data into the data voltage by the use of reference gamma voltages, and supplies the data voltage to each pixel.

12. A method for driving an organic light emitting display device including a display panel for displaying an image by making a light emitting device in each of plural pixels emit light by the use of current corresponding to a data voltage, comprising:

predicting a panel current value flowing in the display panel on the basis of data of a preceding frame and data of a current frame simultaneously displayed on the display panel; and controlling the data voltage used in displaying images on the display panel so as to make the predicted panel current value be lower than a preset current limit value.

13. The method according to claim 12, wherein the process of predicting the panel current value flowing in the display panel comprises:

dividing one frame into a plurality of sub-frames simultaneously displayed with the data of the preceding frame and the data of the current frame; and predicting the panel current value for each sub-frame from the data of the preceding and current frames for each sub-frame.

14. The method according to claim 12, wherein the process of predicting the panel current value flowing in the display panel comprises:

dividing a display area of the display panel into a plurality of division regions; and predicts the panel current value from the data of the preceding frame displayed in some of the division regions and the data of the current frame to be displayed in the remaining division regions.

15. The method according to claim 12, wherein the process of predicting the panel current value flowing in the display panel comprises:

generating conversion data by converting input data;

generating an input data gain value for controlling the luminance properties for the input data of frame unit by analyzing the input data of one frame;

generating a frame current limit gain value which controls the panel current value flowing in the display panel to be lower than the preset current limit value according to the conversion data of frame unit by the use of conversion data of one frame and input data gain value;

dividing one frame into the plurality of sub-frames simultaneously displayed with the data of the preceding frame and the data of the current frame, and generating a plurality of sub- frame current prediction values by predicting the panel current value flowing in the display panel every sub-frame through analysis of the data of the preceding and current frames for each sub- frame;

selecting the largest sub-frame current prediction value as a sub-frame maximum current value among the plurality of sub-frame current prediction values; and predicting the panel current value flowing in the display panel every sub-frame on the basis of the sub-frame maximum current value and the current limit value, and generating a panel current limit gain value so as to make the panel current value be lower than the current limit value.

16. The method according to claim 15, wherein the process of generating the plurality of sub-frame current prediction values comprises:

predicting a region current prediction value for each region of the plurality of division regions by analyzing the conversion data to be supplied to each of the division regions of the display panel on the basis of the conversion data of frame unit by the use of conversion date of one frame and input data gain value; and calculating each sub-frame current prediction value by adding the region current prediction value of the preceding frame predicted from the data of the preceding frame to the region current prediction value of the current frame predicted from the data of the current frame among the plurality of region current prediction values every sub-frame.

17. The method according to claim 16, wherein the process of generating the panel current limit gain value comprises:

comparing the sub-frame maximum current value with the current limit value;

if the current limit value is the same as or larger than the sub-frame maximum current value, generating the frame current limit gain value as the panel current limit gain value; and if the current limit value is smaller than the sub-frame maximum current value, extracting the current value of the preceding frame displayed on the display panel, and generating the panel current limit gain value by correcting the frame current limit gain value so as to make the current value by the data of the current frame be a differential current value between the current limit value and the current value of the preceding frame on the bases of the current value of the preceding frame and the current limit value.

18. The method according to claim 15, wherein the process of controlling the data voltage to be displayed on the display panel comprises:

generating a plurality of reference gamma voltages according to the panel current limit gain value; and converting the conversion data of the current frame into the data voltage by the use of reference gamma voltages.

19. The method according to claim 15, wherein the process of controlling the data voltage to be displayed on the display panel comprises:

generating a plurality of reference gamma voltages;

generating correction data by correcting the conversion data of the current frame according to the panel current limit gain value; and converting the correction data of the current frame into the data voltage by the use of reference gamma voltages.

20. The method according to claim 15, wherein the process of controlling the data voltage to be displayed on the display panel comprises:

generating a plurality of reference gamma voltages according to the panel current limit gain value, and simultaneously generating correction data by correcting the conversion data of the current frame according to the panel current limit gain value; and converting the correction data into the data voltage by the use of reference gamma voltages.

21. A display device comprising:

a display panel configured to display overlapped image data that is an addressed image data and addressing image data displayed at the same time, for a partial addressing period of a frame, defined by a vertical synchronous signal; and a driving controller configured to control a voltage of the image data, being displayed on the display panel so that a driving current value is lower than a current limit value set with respect to a reference value, in the partial addressing period of the frame, wherein the drivin controller comprises:

a current limit gain signal generator for generating a current limit gain value, controlling the driving current to be lower more than the current limit value;

a gamma voltage generator for generating a plurality of gamma voltages according to the current limit gain value; and a data driving element for supplying the data voltage to the display panel according to the plurality of gamma voltages.

22. The display device according to claim 21, wherein the frame is divided into a plurality of sub-frames which has a period for the display panel, being displayed with the data of the preceding frame and the data of the current frame at the same time.

23. The display device according to claim 21, wherein the current limit gain signal generator in the driving controller comprises:

a frame current limit value generator for generating a frame current limit value according to a data inputted to the frame;

a current measurement part for measuring a current value of each sub-frame;

a selector part for selecting a maximum current value among measurement current values of the plurality of sub-frames;

a gain value generator for comparing the frame current limit value with the measurement current value of the plurality of sub-frames and generating the current limit gain value.

* * * * *